US011293121B2

(12) United States Patent
Dash et al.

(10) Patent No.: US 11,293,121 B2
(45) Date of Patent: Apr. 5, 2022

(54) WEARABLE LIGHT WEIGHT PROTECTIVE APPAREL

(71) Applicant: Arvind Limited, Gujurat (IN)

(72) Inventors: Satyapriya Dash, Gujarat (IN); Varun Bhat, Gujarat (IN); Rahul Devmal, Gujarat (IN); Vijendra Labade, Gujarat (IN)

(73) Assignee: Arvind Limited

( * ) Notice: Subject to any disclaimer, the term of this patent is extended or adjusted under 35 U.S.C. 154(b) by 187 days.

(21) Appl. No.: 16/320,423

(22) PCT Filed: Feb. 21, 2018

(86) PCT No.: PCT/IN2018/050088

§ 371 (c)(1),
(2) Date: Jan. 24, 2019

(87) PCT Pub. No.: WO2018/154598

PCT Pub. Date: Aug. 30, 2018

(65) Prior Publication Data

US 2019/0249342 A1 Aug. 15, 2019

(30) Foreign Application Priority Data

Feb. 27, 2017 (IN) ..... 201721006892

(51) Int. Cl.
*D03D 1/00* (2006.01)
*D03D 15/513* (2021.01)

(52) U.S. Cl.
CPC ..... *D03D 1/0035* (2013.01); *D03D 15/513* (2021.01); *D10B 2201/02* (2013.01); *D10B 2201/06* (2013.01); *D10B 2201/24* (2013.01); *D10B 2331/02* (2013.01); *D10B 2331/021* (2013.01); *D10B 2401/16* (2013.01)

(58) Field of Classification Search
CPC ..... D10B 2201/02; D10B 2201/06; D10B 2201/24; D10B 2331/021; D10B 2401/16; D03D 15/47; D03D 15/12; D03D 1/0035; D02G 3/443
See application file for complete search history.

(56) References Cited

U.S. PATENT DOCUMENTS

| | | | | |
|---|---|---|---|---|
| 3,686,845 | A | 8/1972 | Okada et al. | |
| 8,209,785 | B2 | 7/2012 | Underwood et al. | |
| 2005/0025962 | A1* | 2/2005 | Zhu | D02G 3/443 428/359 |
| 2010/0285285 | A1* | 11/2010 | Winterhalter | D02G 3/443 428/196 |

(Continued)

*Primary Examiner* — Jeremy R Pierce
(74) *Attorney, Agent, or Firm* — Forge IP, PLLC

(57) ABSTRACT

The present invention relates to fabrics and/or garments/apparel that confer protection to a wearer by resisting break open, and/or by absorbing at least a portion of any incident energy. The fabrics/garments/apparel described herein comprise yarns prepared from blends of polymers and woven in stellar weave. The blend of fibers comprises flame retardant viscose fibers, meta aramid fibers, para aramid fibers, Nylon 66 fibers, and antistatic fibers in a predefined proportion. A process of manufacturing the fabric for wearable light weight protective apparel comprises processes of spinning, weaving, wet processing and garmenting carried out in a predefined manner.

12 Claims, 1 Drawing Sheet

(56) References Cited

U.S. PATENT DOCUMENTS

2015/0191856 A1* 7/2015 Hines ..... D02G 3/443
428/221
2017/0173370 A1* 6/2017 Underwood ..... A41D 31/085

* cited by examiner

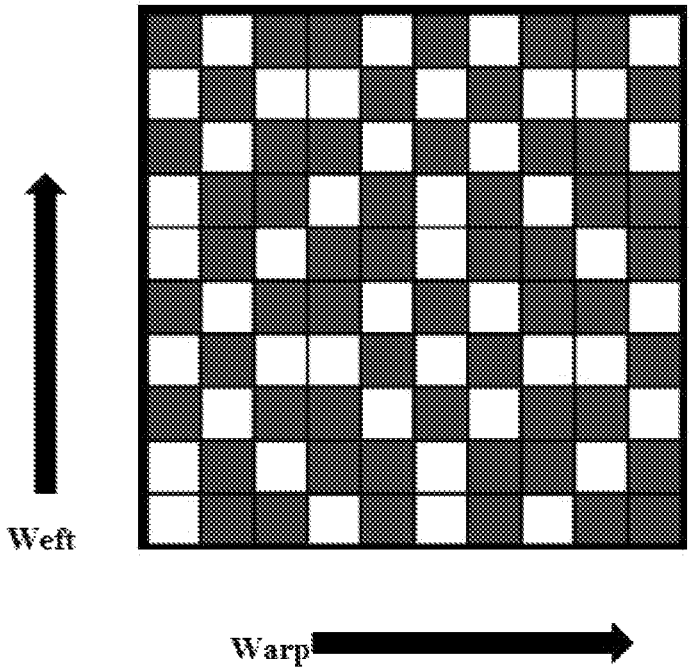
Weft
Warp

WEARABLE LIGHT WEIGHT PROTECTIVE APPAREL

TECHNICAL FIELD OF INVENTION

This disclosure relates to fabrics for flame retardant protective wear which confers protections against, inter alia, electrical arcs and/or flash fires and a method for manufacturing the said fabric.

BACKGROUND OF THE INVENTION

Electrical arcs typically involve thousands of volts and thousands of amperes of electrical current. Flame retardant personal protective-wear is typically used to safeguard a person from a risk of such electric are and/or flash fires. However, when fabrics and garments/apparel are manufactured by using flame-resistant fibers, the fabrics or garments/apparel may break open easily upon exposure to the intense thermal stress of an electrical arc due to lower tensile strength of the flame-resistant fibers. T his break open of the fabric/apparel/wear may render the wearer to additional injury as a result of the incident energy. Further, the electrical arc is much more intense than incident energy such as from a flash fire. Hence, to offer protection to a wearer, the garment or fabric must resist the transfer of the arc energy through the fabric to the wearer. However, due to the break open, a hole forms in the fabric directly which exposes the surface or wearer to the incident energy.

Currently, cotton or cotton/Nylon 66 fabrics/apparels/wears treated with flame retardant solution are available in twill, plain or rip stop weave, but these are heavier in weight (e.g., more than 250 gsm to 450 gsm). It is observed that cotton/modacrylic flame retardant polymer blended fabric/appael/wear is also heavy (e.g., more than 220 gsm (220 to 300 gsm) in twill, plain or rip stop weave. There are fabrics manufactured from blends of modacrylic or Polyacrylic Nitrile (PAN) carbon fiber with aramid but it is observed that they have limited colour options in the 150 to 250 gsm range in twill, plain or rip stop weave. Thus, currently known fabrics have either high weight and/or limited colour options and limited bleach resistance and/or very stringent wash/care instructions.

Moreover, if the workplace contains highly flammable material, the possibility of additional fire hazards increases from static charge that might have developed on the protective wear.

Hence, there is a need for protective apparel which can confer better protection compared to the currently available fabrics/garments/apparel for protective wear and also offer ease and flexibility in terms of weight, color options and wash/care.

SUMMARY OF THE INVENTION

Accordingly, the present invention provides a light weight fabric and/or flame retardant protective wear in the form of garment/apparel that confer protection to a wearer and a method for manufacturing the said fabric/garment/apparel. The light weight fabric of the present invention resists break-open by absorbing incident energy thereby providing protection to the wearer.

The light weight fabrics/garments/apparel described herein comprises yarns prepared from blends of polymer fibers and woven in stellar weave. The blend of polymer fibers include flame retardant viscose fibers, meta aramid fibers, para aramid fibers, Nylon 66 fibers, and optionally antistatic fibers in a predefined proportion. A process of manufacturing the fabric for wearable light weight protective apparel comprises processes of spinning, weaving, and wet processing in a predefined manner.

In the first aspect, the present invention provides a light weight fabric for flame retardant protective wear comprising flame retardant viscose fibers from about 40% to about 60% by weight of total weight of the fabric, meta aramid fibers from about 25% to about 40% by total weight of the fabric, para aramid fibers from about 5% to about 10% by weight of total weight of the fabric, and nylon 66 fibers from about 5% to about 10% by weight of total weight of the fabric. Advantageously, the light weight fabric is substantially free of naturally occurring fibers including cotton, jute and the like or may comprise less than 5% weight of naturally occurring fibers including cotton, jute and the like based on total weight of the light weight fabric.

In an embodiment, the light weight fabric may additionally comprise antistatic fibers from about 0.4% to about 3% by weight of total weight of the fabric.

In the second aspect, the present invention provides a method for manufacturing a light weight fabric of the first aspect for flame retardant protective wear, said method comprising steps of spinning the fibers in pre-determined ratio for forming yarns, weaving of the warped yarns for forming stellar weave fabric, wet processing of the fabric, treating the fabric by a hydrophilic softener on a stenter machine for facilitating soft hand feel to the fabric, and sanforising the treated fabric in length and width for providing the light weight fabric having permanent dimensions.

According to the present invention, the spinning comprising the steps of: treating a fiber in a blow room by opening and blending the fiber in a predetermined ratio, processing the fiber in a carding machine for cleaning the impurities, naps thereby providing a output sliver, passing the fiber through a draw frame for making the fibers parallel for removing hooks, winding of the fibers were carried out to make a bigger package, steaming the fibers to remove a snarling, and parallel winding thereby forming a double yarn.

According to the present invention, said weaving step includes warping the double yarns for making warp sheet for loom processing, sizing the warped double yarn by using a modified starch, a lubricant and a softener for enhancing the weavability of the fiber, and weaving the sized yarns in a predefined pattern on an air jet loom for forming stellar weave fabric.

According to the present invention, the wet processing includes the steps of singeing of the fabric by burning protruding fibers by singeing machine through a gas burner, desizing the fabric for removal of added impurities, washing the fabric with hot water for removal of impurities, vat dyeing of the fabric through pad dry-pad steam process, developing the fabric on a continuous dyeing range machine by padding with a reducing agent followed by steaming, and oxidation of the fabric with $H_2O_2$ followed by washing and drying at a vertical drying range.

According to the present invention, the said fabric has weight from about 140 GS M to about 250 GS M and yarn count from about 2/44 s Ne to about 2/24 s Ne.

BRIEF DESCRIPTION OF THE DRAWINGS

FIG. 1 shows a pattern of a fabric in accordance with an embodiment of the present invention.

DETAILED DESCRIPTION OF THE INVENTION

Although specific terms are used in the following description for sake of clarity, these terms are intended to refer only to particular structure of the invention selected for illustration in the drawings and are not intended to define or limit the scope of the invention.

References in the specification to 'one embodiment' or 'an embodiment' mean that a particular feature, structure, characteristic, or function described in connection with the embodiment is included in at least one embodiment of the invention. The appearances of the phrase 'in one embodiment' in various places in the specification are not necessarily all referring to the same embodiment.

In general aspect, the present invention provides a light weight fabric for a flame retardant personal protective-wear made from a polymer fiber blends and a method for manufacturing thereof. The protective wears/apparels weave thereof provide thermal-protection including arc/flash fire hazard without compromising aesthetic properties like color, breathability and/or durability.

The present invention is illustrated with reference to the accompanying drawings, throughout which reference numbers in brackets indicate corresponding parts in the various FIGURES.

Provided herein are yarns/fabrics and/or garments/apparel which confer thermal protection against flash fires, and electrical arcs. Further, the garments/apparel/fabrics described herein comprise yarns with antistatic fibers thereby reducing the risk of static charge and consequent fire hazards associated with static energy. The yarns, fabrics and garments/apparel described herein resist the transfer of energy when exposed to the intense thermal stress of an electrical arc. Without being bound by any theory, it is believed that the fabrics described herein reduce energy transfer by absorbing a portion of the incident energy which allows for a reduction in transmitted energy. Further, the wearable protective wear fabrics described herein are light weight, artificial fabrics. As used herein, artificial/man-made fabrics may comprise regenerated and/or synthetic fibers/yarns/filaments comprised of organic and/or inorganic material.

In an embodiment, the light weight fabric for a flame retardant personal protective-wear comprises a flame retardant viscose fiber from about 40% to about 60% by weight of total weight of the fabric, a meta aramid fiber from about 25% to about 40% by total weight of the fabric, a para aramid fiber from about 5% to about 10% by weight total weight of the fabric, and nylon 66 from about 5% to about 10% by weight of total weight of the fabric. However, it is understood here that materials/ingredients and weight % thereof may vary in alternative embodiments of the present invention.

In an embodiment, the light weight fabric may in addition, comprise an antistatic fiber from about 0.4% to about 3% by weight of total weight of the fabric.

According to the present invention the light weight fabric has weight from about 140 to about 250 G SM and yarn count from about 2/44 s Ne to about 2/24 s N e.

The light weight fabric preferably comprises a stellar weave. The stellar weave imparts high tearing strength of 50 N in 150 gsm along with good wicking properties.

The aramid fiber, including meta aramid and para aramid, confers higher tensile strength to the fabric. In an embodiment, the fabric is a flame retardant fabric. In the context of the present invention, the fabric is a man-made light weight fabric. The man-made means substantially free of naturally occurring fibers like cotton or jute preferably having less than about 5% by weight of naturally occurring fibers based on total weight of the fabric. In accordance with the preferable embodiment of the present invention, the flame retardant viscose fibers include rayon fibers wherein the flame retardants are incorporated at the time of solution spinning. Rayon fibers refer to regenerated cellulose fiber. However, it is understood here that the flame retardant fabric may include different materials in alternative embodiments of the present invention.

In accordance with this embodiment, the presence of lower amounts of thermoplastic fiber, nylon 66, from about 5% to about 10% by weight of total fabric weight confers higher thermal stability compared to other fabrics. The stellar weave al lows for a larger number of air pockets which improves the electrical arc rating and thermal protection. In alternative embodiments, dope dyed meta-aramid may be used and the fabric may be dyed with vat dyes thereby allowing for fastness of colors. Due to the colors fastness, there are no limitations on wash care of the light weight fabric of the present invention or apparel thereof like bleaching or drying. Further, the vat dyeing process overcomes limitations with respect to colors of the fabrics. As the fabric comprises the flame retardant fiber, the fabric is a flame resistant substantially throughout the life thereof.

In accordance with present invention, provided herein is a method for manufacturing the light weight fabric for a flame retardant protective-wear including garments, apparels and the like. The process for manufacturing the fabric includes sequential steps namely spinning, weaving, wet processing and garmenting.

It is to be noted here that the generally two types of spinning methods are used for the fiber production, namely melt spinning and solution spinning. A melt spinning method is used for a thermoplastic fiber such as nylon 66, and a solution spinning method is used for production of a pigment colored aramid fibers. The solution spinning process provides producer color or dope dyed yarn/fabric.

The process initiates with an initial step of spinning. In this step, the fibers are converted into yarns. In this step, different types of fiber blends/polymer blends are selected according to the end use requirements for the yarn. The blend of the fibers includes flame retardant viscose fibers from about 40% to about 60% by weight of the total weight of the fabric, a producer color meta aramid from about 25% to about 40% by weight of the total weight of the fabric, a para aramid from about 5% to about 10% by weight of the total weight of the fabric, and nylon 66 from about 5% to about 10% by weight of the total weight of the fabric. The blend of the fibers may additionally include antistatic fibers from about 0.4% to about 3% by weight of the total weight of the light weight fabric to impart antistatic characteristics in the light weight fabric.

In accordance with the present invention, the yarn count varies from about 2/24 Ne to about 2/44 Ne (double yarn) but the twist multiplier of 4.2 remains constant. The twist multiplier remains constant for any count of yarn (single yarn). The spinning is conducted in a ring spinning system. The process includes treating the fibers sequentially in a blow room, a carding machine, a draw frame, a speed frame and a ring frame, thereafter the fibers are treated with the processes as a winding, a steaming, a parallel winding and a twisting in a predefined sequence.

In a first step, the fibers are treated in the blow room wherein the different fibers undergo opening and blending in a specific proportion. Thereafter, the blended fibers are sent to a machine by a chute feed system. At this step, spinning oil is added to reduce antistatic charge and increase fiber cohesive force. In a next step, the fibers treated in the blow room are passed through the carding machine that cleans all the impurities, naps etc. and provide sliver output.

In the next step, the fibers are passed through the draw frame. In the draw frame, the fibers are made more parallel by drafting and removing hooks. In the next step, the fibers are passed through the speed frame that is used to make roving that is the input material of the ring frame. The ring frame is used to make a single yarn, a separate specialized ring frame line, having approximately 30 mm diameter of drafting roller for aramid blended yarn and for fiber having staple length 51 mm is used. In a typical normal ring frame, according to the preferred embodiment of the invention fibers up to 48 mm (less than 48 mm) staple length may be used. However, it is understood here that dimensions and type of the ring frame may vary in alternative embodiments of the present invention.

In next step, winding of the fibers is carried out to make a bigger package and remove objectionable faults like thick and thin segments from the ring yarn. Thereafter, the steaming process is conducted to remove a snarling thereby eliminating any tendency for undesirable torqueing. The yarn is made to relax till it gets stable, thereafter subjected to steam treatment in an autoclave at 90° C. for 1 hour. Thereafter, two yarns are wound by a process of parallel winding thereby forming a double yarn. The double yarn gives good luster and strength while having the same resultant count of the single yarn. In the next step, the twisting of the yarn is carried out to give a required twist in the yarn. Accordingly, twist multiplier is kept 3.9 to obtain required in the yarn.

The yarns are the subjected to a process of weaving that includes warping followed by a sizing of the wrapped yarns. The warping includes making warp sheet for loom processing. The warping is followed by the sizing. In this one experiment, a water-soluble sizing is done by using a modified starch, a lubricant and a softener, that is removable by washing at 70° C. The water-soluble sizing enhances the weavability of the fiber/yarns/filaments. However, it is understood here that another sizing process may be used in alternative embodiments of the present invention. The sized yarns (weft yarn and warp yarn) are weaved in a predefined pattern as shown in FIG. 1 in an air jet loom with 12 shafts drafting at 1000 rpm loom speed thereby forming a stellar weave fabric. The stellar weave is a new dobby weave and looks approximately star-like.

In accordance with this process, wet processing includes six steps. The wet processing initiates from singeing of the fabric followed by desizing thereof. In next steps washing, vat dyeing, finishing and sanforising are carried out sequentially to provide a light weight fabric for flame retardant protective wear.

In the first step of wet processing, the singeing process is performed by burning protruding fibers by singeing machine through a gas burner. The singeing improves the resistance to pilling thereby imparting luster to the fabric. In a next step, added impurities like size, spinning oil etc. are removed by oxidative desizing. In this process the fabric is treated with a mixture of $H_2O_2$ of about 25 gpl, NaOH of about 30 gpl, a sequestering agent of about 2 gpl and a wetting agent of about 2 gpl below over a reaction time of 8 Hr. In the next step, the fabric is washed with hot water to remove impurities.

In accordance with this process, in the next step, vat dyeing is done through PDPS (Pad dry-pad steam) process. In this process, the fabric is padded with vat dye and auxiliary and the fabric is dried at 140° C. thereafter. Then the fabric is developed on a continuous dyeing range (CDR) machine by padding with a reducing agent followed by steaming for approximately 1 minute, followed by oxidation with $H_2O_2$ and washing and drying at a vertical drying range (VDR). In the next step, the fabric is given a soft hand feel by hydrophilic softener on a stenter machine. At this step, other durable features like anti-microbial finish, water and oil repellants, stain release agents are incorporated.

Thereafter, the fabric is allowed to shrink in length as well as width, to provide a light weight fabric having permanent dimension and for manufacturing the flame retardant protective apparel. T his step is known as sanforising.

The light weight fabric of the present invention is breathable i.e. air permeable, moisture vapour permeable that help to reduce perspiration and provide greater comfort to the user for longer periods of time. The MVTR (Moisture Vapour Transmission Rate) for the light weight fabric of the present invention as per ASTM E-96-05 is more than 2000 gm/M2/Day. In an embodiment, the fabrics have high abrasion resistance of more than 50000 revolutions in an abrasion test. ISO 12947-2, AST M D4966 compatible abrasion testing is conducted for testing the abrasion resistance of the fabric. The light weight fabric is also dimensionally stable i.e., display reduced or minimal stretching or shrinking, and optionally further comprise other functional durable finishes such as an anti-microbial finish, water and oil repellant coatings, stain release coatings and the like, without affecting protective performance.

The sanforising is followed by garmenting to make flame retardant protecting wear. In the garmenting step, flame retardant protecting wear are made by the light weight fabric of the present invention with flame retardant trims. The flame retardant protecting wear i.e. garments/apparels are light weight and comply all the required standards defined as of date.

Example 1

The light weight fabric was manufactured with the process as claimed and disclosed in the specification. The light weight fabric had 50% of Rayon as the flame retardant viscose fiber by weight of total weight of the fabric, 33% of a meta aramid fibers by total weight of the fabric, 5% of para aramid fibers by weight total weight of the fabric, 10% Nylon 66 from by weight of total weight of the fabric, and 2% of antistatic fibers from by weight of total weight of the fabric. The light weight fabric had weight 150 GSM and yarn count 2/40 sNe.

The light weight fabric of above composition was tested. The testing process included the following steps: the fabric was pulled taut and loaded onto lower plates of a Martindale machine. In this machine, small discs of abradant such as worsted wool or a wire mesh and the like continually rubbed against the test specimens in an oscillating circle with a load of approximately 12 kpa based on fabric weight (grams per square meter (gsm)). The fabric was continually inspected for wear and tear, and the test is finished when two yarns of the fabric break.

| TEST | METHOD | STD | UNIT | RESULTS |
|---|---|---|---|---|
| Abrasion Resistance | ISO 12947-1 | | REV | >30,000 Rev |

Further, Arc Thermal Protective Value (ATPV) refers to the maximum incident energy (in calories per centimetre squared) that protective equipment can be exposed to and prevent onset of a second-degree burn. Ratings are based upon the total weight of the fabric. A Hazard Risk Category (HRC) level was determined by the minimum amount of calories per square centimetre (ATPV or Cal/cm2). It is to be noted here that any treated garment must pass through with a 50% probability of a 2nd or 3rd degree burn occurring, which is how the protective level of the treated clothing is determined. The higher the ATPV, the higher the HRC level attained, the greater the protection that is needed. Typical H RCs levels are as follows.

HRC 1: 4 Cal/Cm2 ≠ ATPV<8 Cal/Cm2

HRC 2: 8 Cal/cm2 ≠ ATPV<25 Cal/cm2

HRC 3: 25 Cal/cm2 ≠ ATPV<40 Cal/cm2

HRC 4: 40 Cal/cm2 ≠ ATPV

It was found that the tested fabric of the present invention provided ATPV of 7.9 cal/cm2 (HRC 1) and 150 gsm and AT PV 9.5 cal/cm2 (HRC 2) at 180 gsm.

COLOR FASTNESS TEST

| | | | CC | AC | C | N | P | ACR | W |
|---|---|---|---|---|---|---|---|---|---|
| Colour Fastness to washing | ISO 105 C06 | Rating | 4 | 4 | 4 | 3-4 | 4 | 4 | 4 |
| Colour Fastness to Acid Perspiration | ISO 105 E05 | Rating | 4 | 4 | 4 | 4 | 4 | 4 | 4 |
| Colour Fastness to Alkali | ISO 105 E06 | Rating | 4 | 4 | 4 | 4 | 4 | 4 | 4 |
| Colour Fastness to Water | ISO 105 E01 | Rating | 4 | 4 | 4 | 4 | 4 | 4 | 4 |
| Dry Rub | ISO 105 × 12 | Rating | | | | 3-4 | | | |
| Wet Rub | ISO 105 × 12 | Rating | | | | 3 | | | |

The embodiments were chosen and described in order to best explain the principles of the present invention and its practical application, to thereby enable others, skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the present invention.

The invention claimed is:

1. A light weight fabric for flame retardant protective wear, comprising:

flame retardant viscose fibers from about 40% to about 60% by weight of total weight of the fabric;

meta aramid fibers from about 25% to about 40% by weight of total weight of the fabric;

para aramid fibers from about 5% to about 10% by weight of total weight of the fabric;

nylon 66 fibers from about 5% to about 10% by weight of total weight of the fabric;

antistatic fibers from about 0.4% to about 3% by weight of total weight of the fabric; and less than 5% by weight of naturally occurring fibers.

2. The light weight fabric as claimed in claim 1, wherein the fabric is substantially free of naturally occurring fibers including cotton and jute.

3. The light weight fabric as claimed in claim 1, wherein the flame retardant viscose fibers preferably includes rayon fibers.

4. The light weight fabric as claimed in claim 1, wherein the light weight fabric has weight from about 140 GSM to about 250 GSM.

5. The light weight fabric as claimed in claim 1, wherein the light weight fabric has yarn count from about 2/44s Ne to about 2/24s Ne.

6. The light weight fabric as claimed in claim 1, wherein the fabric is stellar weave.

7. The light weight fabric as claimed in claim 1, wherein the amount of para aramid fibers is between 12.5% and 40% of the amount of meta aramid fibers.

8. The light weight fabric as claimed in claim 1, wherein the fabric comprises:

rayon of about 50% by weight of the total weight of the fabric;

meta aramid fibers of about 33% by weight of the total weight of the fabric;

para aramid fibers of about 5% by weight of the total weight of the fabric;

nylon 66 fibers of about 10% by weight of the total weight of the fabric;

antistatic fibers of about 2% by weight of the total weight of the fabric.

9. A flame retardant protective wear comprising a light weight fabric as claimed in claim 1.

10. A process of manufacturing a light weight fabric for flame retardant protective wear, comprising the steps:

spinning the fibers forming yarns wherein said spinning comprising the steps of:

treating the fibers in a predetermined ratio in a blow room by opening and blending the fiber in a predetermined ratio;

processing the fiber in a carding machine for cleaning the impurities, naps thereby providing an output sliver;

passing the fiber through a draw frame for making the fibers parallel for removing hooks;

winding of the fibers were carried out to make a bigger package;

steaming the fibers to remove a snarling; and parallel winding thereby forming a double yarn;

weaving of the yarns wherein said weaving further comprising the steps of:

warping the double yarns for making warp sheet for loom processing;

sizing the warped double yarn by using a modified starch, a lubricant and a softener for enhancing the weavability of the fiber; and weaving the sized yarns in a predefined pattern on an air jet loom for forming stellar weave fabric;

wet processing of the fabric wherein said wet processing further comprising the steps of:

singeing of the fabric by burning protruding fibers by singeing machine through a gas burner;

desizing the fabric for removal of added impurities;

washing the fabric with hot water for removal of impurities;

vat dyeing of the fabric through pad dry—pad steam process;

developing the fabric on a continuous dyeing range machine by padding with a reducing agent followed by steaming;

oxidation of the fabric with H2O2 followed by washing; and drying at a vertical drying range;

treating the fabric by a hydrophilic softener on a stenter machine for facilitating soft hand feel to the fabric; and sanforising the treated fabric in length and width for providing the light weight fabric having permanent dimensions;

wherein the light weight fabric comprises the fabric as claimed in claim 1.

11. A process for making flame retardant protective wear comprising garmenting of the light weight fabric as claimed in claim 1.

12. A process for making flame retardant protective wear comprising garmenting of the light weight fabric manufactured by a process as claimed in claim 10 wherein said garmenting made with flame retardant trims.

* * * * *